US008075130B2

(12) United States Patent
Kuriki

(10) Patent No.: US 8,075,130 B2
(45) Date of Patent: Dec. 13, 2011

(54) WORK DEVICE AND IMAGE RECORDING APPARATUS EQUIPPED WITH THE WORK DEVICE

(75) Inventor: Kumiko Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 529 days.

(21) Appl. No.: 12/341,156

(22) Filed: Dec. 22, 2008

(65) Prior Publication Data

US 2009/0167834 A1 Jul. 2, 2009

(30) Foreign Application Priority Data

Dec. 28, 2007 (JP) ..... 2007-339401

(51) Int. Cl.
*B41J 29/13* (2006.01)

(52) U.S. Cl. ..... 347/108

(58) Field of Classification Search ..... 347/108
See application file for complete search history.

(56) References Cited

U.S. PATENT DOCUMENTS

| | | | | |
|---|---|---|---|---|
| 7,946,677 | B2 * | 5/2011 | Tamaki | 347/37 |
| 2007/0159509 | A1 * | 7/2007 | Kawamata et al. | 347/37 |

FOREIGN PATENT DOCUMENTS

| | | | |
|---|---|---|---|
| JP | 2004-268346 | A | 9/2004 |
| JP | 2005-035032 | A | 2/2005 |
| JP | 2005-035033 | A | 2/2005 |
| JP | 2006-256230 | A | 9/2006 |

* cited by examiner

*Primary Examiner* — Matthew Luu
*Assistant Examiner* — Lisa Solomon
(74) *Attorney, Agent, or Firm* — Baker Botts L.L.P

(57) ABSTRACT

A work device, including: a reciprocable movable member; a lengthy member connected to the movable member at its first-end-side portion, so as to extend in a first direction, and is elastically curved toward a second direction different from the first direction so that its second-end-side portion is fixed at a prescribed position, the lengthy member being operable to follow a reciprocating movement of the movable member; and a guide member having a first guide surface extending along the second direction, a second guide surface extending in a third direction intersecting the second direction, and a third guide surface contiguous to the first and second guide surfaces, wherein the third guide surface is configured such that a boundary point in the lengthy member transits on the third guide surface from the first guide surface toward the second guide surface when the lengthy member contacting the first guide surface moves so as to come into contact with the second guide surface following the movable member, the boundary point defining a boundary between a region of the lengthy member that is in contact with the third guide surface and a region of the lengthy member that is not in contact with the third guide surface.

6 Claims, 11 Drawing Sheets

WORK DEVICE AND IMAGE RECORDING APPARATUS EQUIPPED WITH THE WORK DEVICE

CROSS REFERENCE TO RELATED APPLICATION

The present application claims priority from Japanese Patent Application No. 2007-339401 which was filed on Dec. 28, 2007, the disclosure of which is herein incorporated by reference in its entirety.

BACKGROUND OF THE INVENTION

1. Field of the Invention

The present invention relates to a work device including a lengthy member which follows a movable member configured to reciprocate in a certain direction and which is guided by a guide member and also relates to an image recording apparatus equipped with the work device.

2. Discussion of Related Art

There has been conventionally known an image recording apparatus of an ink-jet system configured to record an image on a recording medium by ejecting ink based on input signals. As the ink-jet system, there has been known a system in which the ink is introduced to an actuator such as a piezoelectric element or an electrostrictive element disposed in a recording head and droplets of the ink are ejected from nozzles by deformation or deflection of the actuator in accordance with the input signals. There has been also known, as the ink-jet system, a system in which the ink pressurized utilizing local boiling thereof by a heat-generating element is ejected as the ink droplets.

The ink-jet recording head is mounted on a carriage so as to be moved relative to the recording medium such as a recording sheet, for instance. The carriage is configured to be driven by a drive force transmitted from a drive source such as a motor for thereby reciprocating in a certain direction while being guided by guide shafts, guide rails, or the like. During the reciprocating movement of the carriage, the ink droplets are selectively ejected from the recording head toward the recording medium, so that an image is recorded by the ink droplets attached to the recording medium.

For supplying the ink from an ink cartridge to the recording head, there is employed a method using ink tubes. Each of the ink tubes defines a flow path through which the ink flows to the recording head from the ink cartridge disposed separately from the recording head. The ink tube has flexibility that allows the ink tube to follow the reciprocating movement of the carriage. The ink tube has a length that is determined considering a distance between the carriage and the ink cartridge when the carriage is located at a position that is the most distant from the ink cartridge. When the carriage is located at a position that is the nearest to the ink cartridge, the ink tube is curved into a substantially U-shape, for instance.

Patent Document 1 discloses an arrangement in which inks of four colors accommodated in respective ink cartridges are supplied to a carriage (1) via respective four ink supply tubes (87). Each of the four ink supply tubes is curved into a generally U-shape that has a bent portion (W). In the disclosed arrangement, owing to a guide member (89), a direction of a restoring force of the bent portion (W) of the ink supply tube that acts on the carriage is made equal to a direction substantially perpendicular to a direction of the reciprocating movement of the carriage, namely, made equal to a direction substantially perpendicular to a main scanning direction (X). Accordingly, the restoring force of the bent portion (W) does not act obliquely on the carriage, so that the carriage is prevented from being inclined, avoiding a deterioration in the accuracy with which the liquid or ink is ejected.

Patent Document 1 JP-A-2004-268346

SUMMARY OF THE INVENTION

In the arrangement described above, however, when the ink tubes come into contact with the guide member, there is generated a butting noise, causing a problem that a operation sound generated in the image recording operation becomes large. The butting noise tends to become large with an increase in the speed of the reciprocating movement of the carriage for speeding up the image recording operation.

On the other hand, where the guide member is not provided, the ink tube that follows the carriage moves freely or disorderly, whereby components or members located near the ink tube may be damaged or there may be caused a risk of generating the above-indicated force which acts on the carriage so as to incline the carriage.

The problems indicated above may be experienced not only in the image recording apparatus, but also in an image reading device such as a flatbed-type scanner having an image sensor mounted on the carriage and configured to be moved relative to a document to scan an image on the document.

The present invention has been developed in the light of the situations indicated above. It is therefore an object of the invention to provide a work device in which a butting noise generated when a lengthy member following a movable member comes into contact with a guide member is reduced and which realizes a smooth reciprocating movement of the movable member by stabilizing a force that applies from the lengthy member to the movable member upon a reciprocating movement of the movable member.

The above-indicated object may be attained according to a principle of the invention, which provides a work device, comprising: a movable member configured to reciprocate in a certain direction; a lengthy member which is connected to the movable member at a first-end-side portion near to a first end thereof, so as to extend in a first direction, and is elastically curved toward a second direction different from the first direction so that a second-end-side portion near to a second end thereof is fixed at a prescribed position, the lengthy member being operable to follow a reciprocating movement of the movable member; and a guide member having a first guide surface extending along the second direction, a second guide surface extending in a third direction that intersects the second direction, and a third guide surface contiguous to the first guide surface and the second guide surface, wherein the third guide surface is configured such that a boundary point in the lengthy member transits on the third guide surface from the first guide surface toward the second guide surface when the lengthy member contacting the first guide surface moves so as to come into contact with the second guide surface following the reciprocating movement of the movable member, the boundary point, defining a boundary between a region of the lengthy member that is in contact with the third guide surface and a region of the lengthy member that is not in contact with the third guide surface.

The work device according to the invention may be realized in a printer whose recording head is mounted on the movable member or in a scanner whose image sensor is mounted on the movable member, for instance. The movable member is configured to reciprocate in a certain direction by a drive force transmitted from a drive source such as a motor. The direction of reciprocation of the movable member may be constituted by mutually opposite two directions.

The lengthy member is connected to the movable member. The lengthy member assumes a tube-like shape or a ribbon-like shape and is long in a direction in which it extends. As the lengthy member, there may be employed an ink tube through which ink flows where the work device is realized in the printer and a cable for transmitting electric signals where the work device is realized in the scanner. The first-end-side portion of the lengthy member is connected to the movable member while the second-end-side portion is connected to a component different from the movable member, such as a main body of the device. A portion of the lengthy member interposed between the first-end-side portion and the second-end-side portion is curved in a generally U-shape from the first direction toward the second direction and is elastically deformed following the reciprocating movement of the movable member. The first direction and the second direction may coincide with the direction of the reciprocating movement of the movable member.

The shape of the lengthy member is controlled by the guide member. The guide member includes the first guide surface contacting the lengthy member and the second and third guide surfaces with which the lengthy member comes into contact. The third guide surface is configured such that the boundary point in the lengthy member defined as described above transits on the third guide surface from the first guide surface toward the second guide surface when the lengthy member contacting the first guide surface moves so as to come into contact with the second guide surface following the movable member. Accordingly, the lengthy member comes into contact with the third guide surface before it comes into contact with the second guide surface, and the boundary point in the lengthy member transits on the third guide surface toward the second guide surface, whereby the lengthy member comes into contact with the second guide surface while being guided in a direction from the second direction toward the third direction. In other words, the lengthy member is guided so as to come into gentle or moderate contact with the second guide surface.

BRIEF DESCRIPTION OF THE DRAWINGS

The above and other objects, features, advantages and technical and industrial significance of the present invention will be better understood by reading the following detailed description of a presently preferred embodiment of the invention, when considered in connection with the accompanying drawings, in which.

DETAILED DESCRIPTION OF THE PREFERRED EMBODIMENT

There will be described in detail a preferred embodiment of the present invention with reference to the accompanying drawings. In the present embodiment, there is illustrated a multi-function device 10 as one example of an image processing apparatus equipped with a work device according to the present invention. It is to be understood that the present invention is not limited to the multi-function device 10 but may be otherwise modified without departing from the principle of the invention.

1. Schematic Structure of Multi-Function Device

Figure 1:
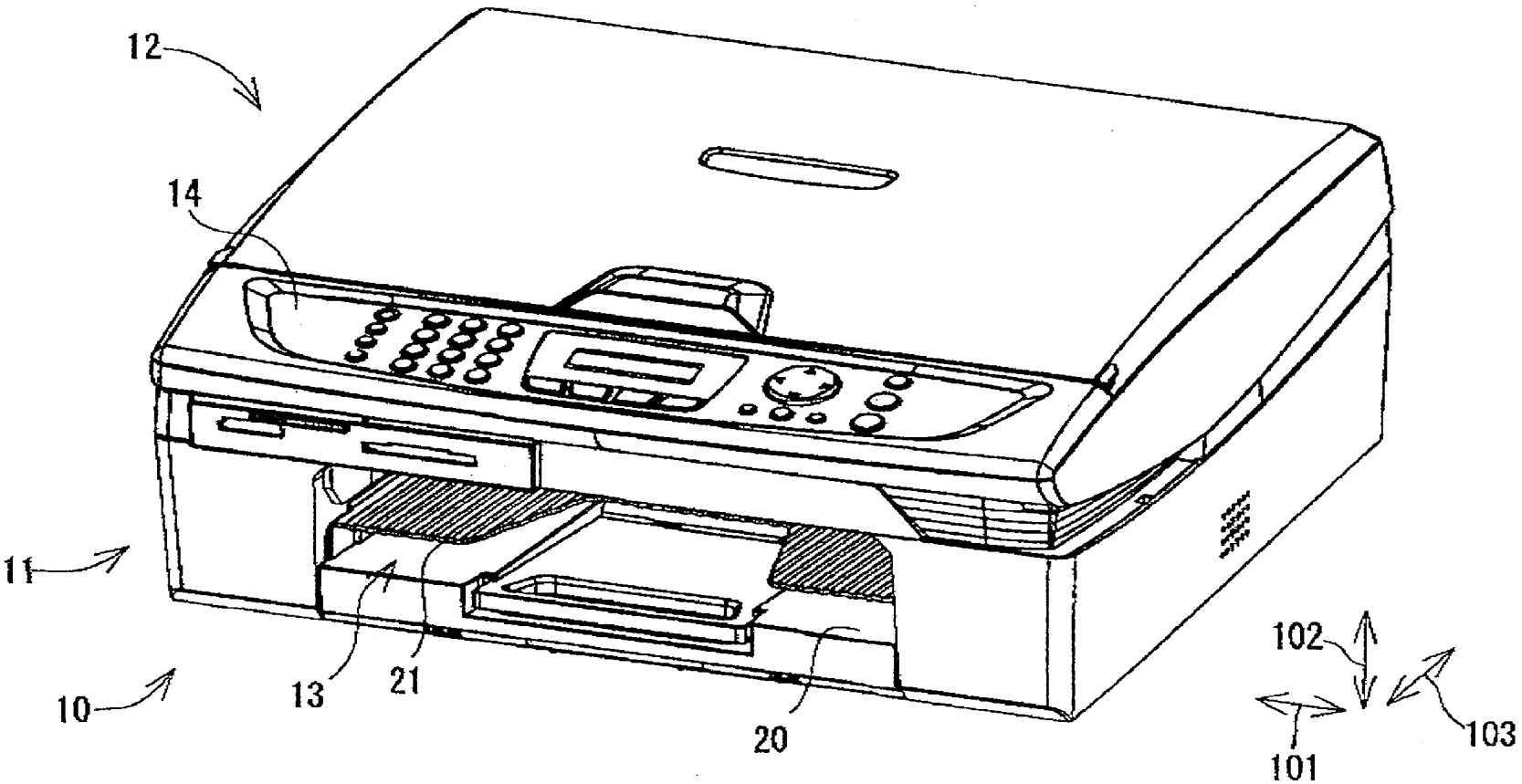
FIG. 1 is a perspective view showing an external structure of a multi-function device according to one embodiment of the present invention.
Figure 2:
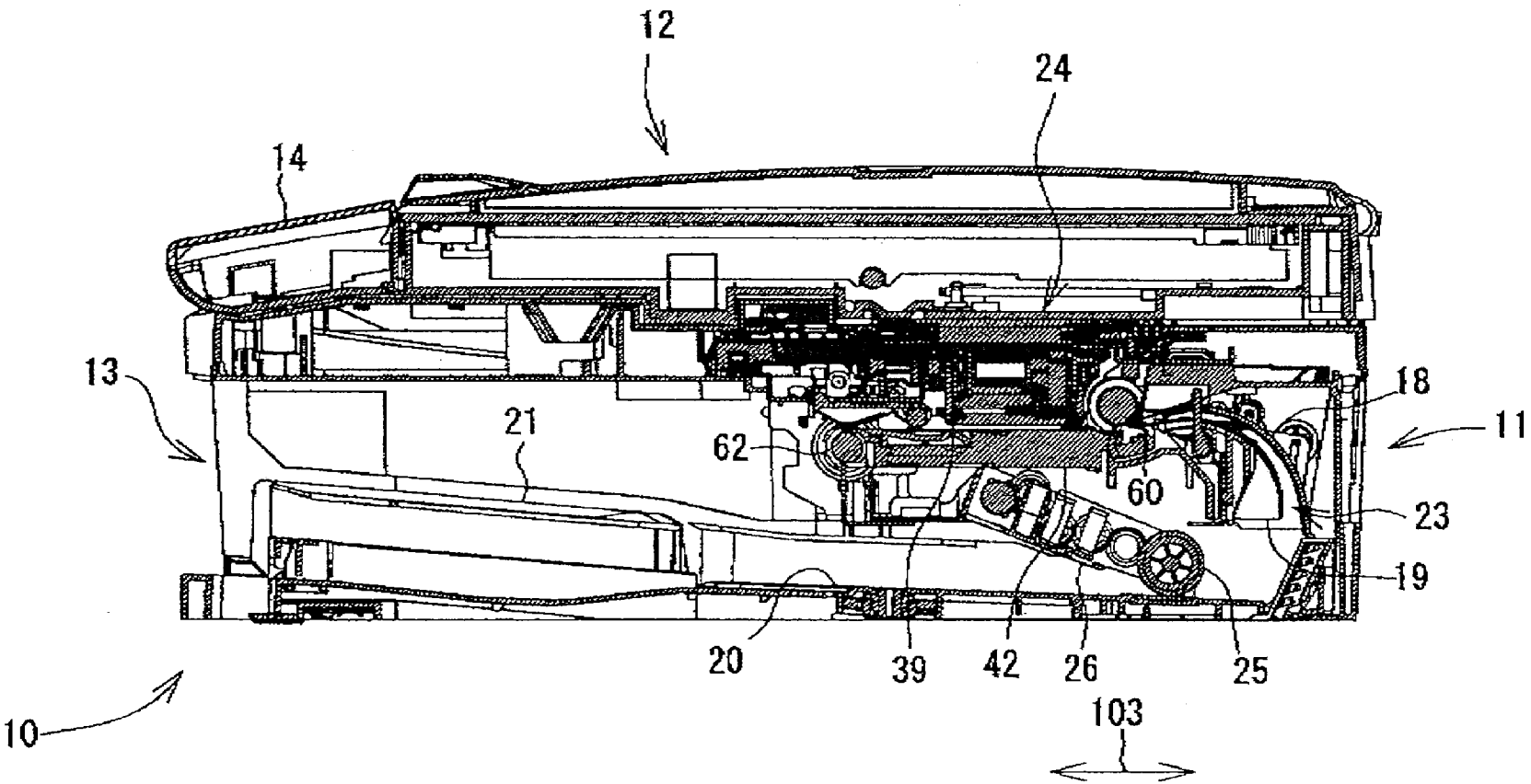
FIG. 2 is a vertical cross-sectional view showing an internal structure of the multi-function device of FIG. 1.

As shown in FIGS. 1 and 2, the multi-function device 10 integrally includes a printing section 11 and a scanning section 12 and has a printing function, a scanning function, a copying function, and a facsimile function. The printing section 11 corresponds to an image recording apparatus according to the present invention. It is noted that the functions other than the printing function are optional. The image recording apparatus according to the present invention may be embodied as a single-function apparatus, e.g., a printer which does not have the scanning section 12 and therefore does not have the scanning function and the copying function. The work device according to the present invention is realized integrally with the printing section 11 as described below. It is noted that, in the specification, directional terminology such as "front", "back", "left", "right", "above, "below", etc., is used with respect to an orientation of the multi-function device 10 disposed for its intended use, unless otherwise specified.

The printing section 11 is disposed at a lower portion of the multi-function device 10 while the scanning section 12 is disposed at an upper portion of the same 10. The multi-function device 10 is connected to external information equipment such as a computer, whereby the printing section 11 performs recording of images and characters on a recording medium based on print data including image data and document data transmitted from the external information equipment. The scanning section 12 is a so-called flatbed type scanner.

The multi-function device 10 is wide and flat type with its width (indicated by an arrow 101 in FIG. 1) and depth (indicated by an arrow 103 in FIG. 1) being made larger than its height (indicated by an arrow 102 in FIG. 1) and has a generally rectangular parallelepiped configuration. The printing section 11 has a front opening 13 in which a sheet supplying tray 20 and a sheet receiving tray 21 are provided. A recording sheet as the recording medium accommodated in the sheet supplying tray 20 is conveyed to an inside of the printing section 11 at which a desired image is recorded, and the recording sheet on which the image has been recorded is discharged onto the sheet receiving tray 21.

At the upper portion on the front side of the multi-function device 10, there is provided an operator's control panel 14 through which suitable inputting is made for permitting the printing section 11 and the scanning section 12 to work as intended. The control panel 14 includes a plurality of buttons and a display on which are indicated a status of the multi-function device 10, an error message, and the like. Where the multi-function device 10 is connected to the external information equipment, the multi-function device 10 operates also based on instructions transmitted from the external information equipment via communication software such as a printer driver and a scanner driver.

2. Printing Section

As shown in FIG. 2, the sheet supplying tray 20 is disposed at a bottom part of the multi-function device 10. The sheet receiving tray 21 is superposed on the sheet supplying tray 20 in the vertical direction. The sheet supplying tray 20 and the sheet receiving tray 21 are connected via a sheet conveying path 23 through which the recording sheet is conveyed. A direction in which the recording sheet is conveyed through the sheet conveying path 23 is hereinafter referred to as a "sheet-conveyance direction" The recording sheet accommodated in the sheet supplying tray 20 is conveyed to an image recording unit 24 while being guided through the sheet conveying path 23 so as to make a U-turn upwards. After an image has been recorded on the recording sheet by the image recording unit 24, the recording sheet is discharged onto and received by the sheet receiving tray 21.

The sheet supplying tray 20 has a container-like configuration opening upwards. In an internal space of the sheet supplying tray 20, a stack of the recording sheets is accommodated. The sheet supplying tray 20 can accommodate recording sheets in various sizes equal to or smaller than an A3 size, such as an A4 size, a B5 size, and a postcard size.

The sheet receiving tray 21 has a tray-like configuration on which are discharged the image-recorded sheets. The sheet receiving tray 21 is disposed nearer to the front side of the multi-function device 10 than the sheet supplying tray 20, in the depth direction (indicated by the arrow 103 in FIG. 2). Accordingly, on the back side of the device 10, the sheet receiving tray 21 does not overlap the sheet supplying tray 20.

At a portion of the sheet supplying tray 20 corresponding to the back side of the device 10, a sheet supplying roller 25 is provided. The sheet supplying roller 25 is configured to supply the recording sheets stacked on the sheet supplying tray 20 one by one to the sheet conveying path 23. The sheet supplying roller 25 is rotated by a drive force transmitted from a motor (not shown) and is rotatably supported by a free end of a roller support arm 26. The roller support arm 26 is pivotable at its proximal end that is remote from the sheet supplying roller 25, whereby the sheet supplying roller 25 supported by the free end of the roller support arm 26 moves upward so as to separate from the sheet supplying tray 20 and downward so as to approach the same 20. The roller support arm 26 is biased downward by the weight of the sheet supplying roller 25, a spring or the like, and is moved upward in accordance with the amount of the recording sheets accommodated in the sheet supplying tray 20. Thus, the sheet supplying roller 25 is configured to contact an uppermost one of the recording sheets stacked on the sheet supplying tray 20. When the sheet supplying roller 25 is rotated with the uppermost sheet contacting the sheet supplying roller 25, the uppermost sheet is fed to the sheet conveying path 23 owing to a friction force between the surface of the sheet supplying roller 25 and the sheet.

The sheet conveying path 23 extends upward on the back side of the multi-function device 10 and subsequently turns toward the front side of the device 10, so as to extend from the back side toward the front side of the device 10 (as indicated by the arrow 103 in FIG. 2) while passing through the image recording unit 24 and finally reaching the sheet receiving tray 21. The sheet conveying path 23 is constituted by an outer guide surface and an inner guide surface facing each other with a predetermined distance interposed therebetween, except a portion thereof where the image recording unit 24 is disposed. For instance, a curved portion of the sheet conveying path 23 located on the back side of the device 10 is constituted by an outer guide member 18 and an inner guide member 19 fixed to a frame of the device 10.

The image recording unit 24 is constituted mainly by a recording head 39 and a platen 42 which face each other with a predetermined distance therebetween. The structure of the image recording unit 24 will be explained in detail.

On the upstream side of the image recording unit 24 in the sheet-conveyance direction, a sheet conveying roller 60 and a pinch roller are disposed as a pair. In FIG. 2, the pinch roller is hidden from view by other components. The pinch roller is disposed under the sheet conveying roller 60 so as to be in pressing contact with the same 60. The sheet conveying roller 60 is rotated by a drive force transmitted from a motor (not shown). The recording sheet being conveyed through the sheet conveying path 23 is pinched by and between the sheet conveying roller 60 and the pinch roller, so as to be conveyed onto the platen 42.

On the downstream side of the image recording unit 24 in the sheet-conveyance direction, a sheet discharging roller 62 and a spur are disposed as a pair. In FIG. 2, the spur is hidden from view by other components. The spur is disposed over the sheet discharging roller 62 so as to be in pressing contact with the same 62. The sheet discharging roller 62 is rotated by a drive force transmitted from a motor (not shown). The recording sheet on which the image has been recorded is pinched by and between the sheet discharging roller 62 and the spur, so as to be conveyed onto the sheet receiving tray 21.

3. Schematic Structure of Image Recording Unit

The work device according to the present invention is realized by including a carriage 38, ink tubes 41, and a guide member 70 in the image recording unit 24. The carriage 38, each ink tube 41, and the guide member 70 respectively correspond to a movable member, a lengthy member, and a guide member in the present invention.

Figure 3:
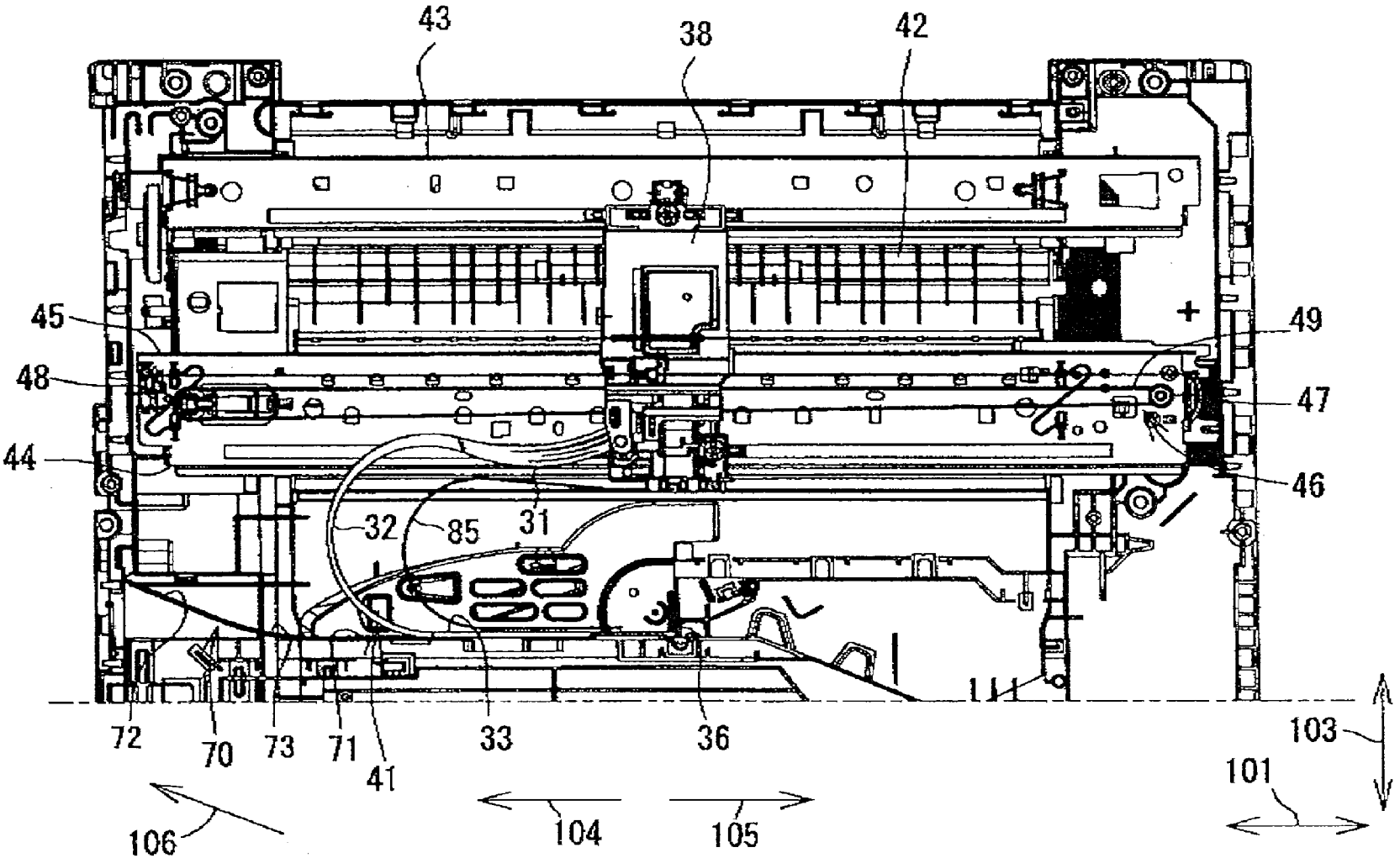
FIG. 3 is a plan view showing a structure around an image recording unit.

While not shown in FIG. 3, the carriage 38 carries the ink-jet recording head 39. To the recording head 39, inks of different colors, i.e., cyan (C), magenta (M), yellow (Y), and black (Bk), are supplied through the respective ink tubes 41 from respective ink cartridges disposed independently of the recording head 39 in the multi-function device 10. While the carriage 38 reciprocates, microdroplets of the inks of the different colors are selectively ejected from the recording head 39, whereby an image is recorded on the recording sheet being conveyed on the platen 42. In FIG. 3, the ink cartridges storing the respective inks are not shown.

As shown in FIG. 3, a pair of guide rails 43, 44 are disposed over the sheet conveying path 23 so as to extend in a direction intersecting the sheet-conveyance direction (i.e., in a left-to-right direction in FIG. 3 indicated by the arrow 101), with a predetermined distance interposed therebetween in the sheet-conveyance direction (from the top to the bottom in FIG. 3). The guide rails 43, 44 are disposed in the casing of the printing section 11 and constitute a part of the frame that supports the components of the printing section 11. The carriage 38 is disposed bridging the guide rails 43, 44 so as to be slidable in the direction of extension of the guide rails 43, 44 (i.e., in the left-to-right direction in FIG. 3 indicated by the arrow 101).

The guide rail 44 has an edge portion 45 on its upstream side in the sheet-conveyance direction. The edge portion 45 is bent upward at a substantially right angle. The carriage 38 supported by the guide rails 43, 44 slidably grips the edge portion 45 by means of a gripping member such as a roller pair, whereby the carriage 38 is positioned in the sheet-conveyance direction and is slidable in the direction intersecting the sheet-conveyance direction (i.e., in the direction perpendicular to the sheet-conveyance direction in the present embodiment). That is, the carriage 38 is slidably supported on the guide rails 43, 44 and is capable of reciprocating along the edge portion 45 in the direction intersecting the sheet-conveyance direction.

A belt drive mechanism 46 is disposed on the upper surface of the guide rail 44. The belt drive mechanism 46 includes: a drive pulley 47 and a driven pulley 48 disposed near opposite ends of the sheet conveying path 23 in the widthwise direction of the same 23 (indicated by the arrow 101 in FIG. 3); and an endless loop-like timing belt 49 stretched around the drive pulley 47 and the driven pulley 48 and having teeth on its inside surface. A drive force is applied from a motor (not shown) to the shaft of the drive pulley 47 for rotating the same 47, and the rotation of the drive pulley 47 causes the timing belt 49 to rotate around the pulleys 47, 48.

While not shown in FIG. 3, the carriage 38 is connected at its bottom surface to the timing belt 49. When the timing belt 49 rotates, the carriage 38 reciprocates on the guide rails 43, 44 along the edge portion 45. The recording head 39 mounted on the carriage 38 also reciprocates in the widthwise direction indicated by the arrow 101 in FIG. 3) of the sheet conveying path 23, together with the carriage 38.

The platen 42 is disposed under the sheet conveying path 23 so as to face the recording head 39. The platen 42 is disposed over a central portion within a reciprocating range of the carriage 38, on which the recording sheet passes. The width of the platen 42 is sufficiently larger than the maximum width of the recording sheet that can be used in the printing section 11. Between the recording sheet supported on the upper surface of the platen 42 and the recording head 39, a constant distance is maintained. The ink droplets ejected from the recording head 39 are attached to the recording sheet thus supported on the platen 42.

4. Ink Tubes

While not shown in FIG. 3, the ink cartridges accommodating the respective inks of the different colors are mounted on a cartridge mount portion of the printing section 11. The four ink tubes 41 corresponding to the respective inks are drawn from the respective cartridges to the carriage 38. The inks are supplied to the recording head 39 mounted on the carriage 38 through the respective tubes 41 connected to the carriage 38.

Each ink tube 41 is made of a synthetic resin material and formed into a straight tube-like configuration. The ink tube 41 has a suitable degree of toughness (i.e., bending rigidity) for keeping its straightness, and further has flexibility that permits the ink tube 41 to be flexed upon application of an external force thereto and elasticity that permits the ink tube 41 to restore to its original shape upon removal of the external force. Owing to the flexibility and elasticity, the ink tube 41 changes in shape following the reciprocating movement of the carriage 38.

The ink tubes 41 drawn from the cartridge mount portion are fixed by a clip 36 provided on a main body of the device 10. Each ink tube 41 is allowed to be freely flexed or deflected, at a portion thereof extending from the clip 36 to the carriage 38, without being fixed to the main body. The ink tube 41 changes in shape at that portion, following the reciprocating movement of the carriage 38. The position of the clip 36 corresponds to a prescribed position at which a second-end-side portion near to a second end of each ink tube 41 as the lengthy member is fixed. In FIG. 3, a part of each ink tube 41 that extends from the clip 36 to the cartridge mount portion (not shown) is not illustrated.

The above-indicated portion of each ink tube 41 extending from the clip 36 to the carriage 38 is drawn in a generally U-shape in which the direction of extension is turned or reversed. The four ink tubes 41 fixed by the clip 36 are piled up in a direction perpendicular to the sheet plane of FIG. 3 (in a direction indicated by the arrow 102 in FIG. 1) while the four ink tubes 41 are arranged in a horizontal direction in the vicinity of the carriage 38. The four ink tubes 41 as a whole are curved in the generally U-shape in plan view of FIG. 3 while being twisted such that the arrangement in the horizontal direction changes into the arrangement in the perpendicular direction from the carriage 38 toward the clip 36.

In each ink tube 41, a section that extends substantially straight in a first direction 104 from a first-end-side portion which is near to a first end of each ink tube 41 and at which the ink tube 41 is connected to the carriage 38 is referred to as a first section 31, a section that is elastically curved from the first section 31 toward a second direction 105 opposite to the first direction 104 is referred to as a second section 32, and a section that extends substantially straight from the second section 32 in the second direction 105 to the second-end-side portion fixed by the clip 36 is referred to as a third section 33. The terms "first-end-side portion" and "second-end-side portion" are used to collectively refer to the respective portions of the ink tube 41 that are respectively near to the opposite ends (the first and the second ends) of the ink tube 41. The first-side-end portion and the second-side-end portion of the ink tube 41 need not be located at the opposite ends of the ink tube 41. For instance, the second-end-side portion may be located intermediate between the opposite ends of the ink tube 41 as illustrated in the present embodiment.

Figure 6:
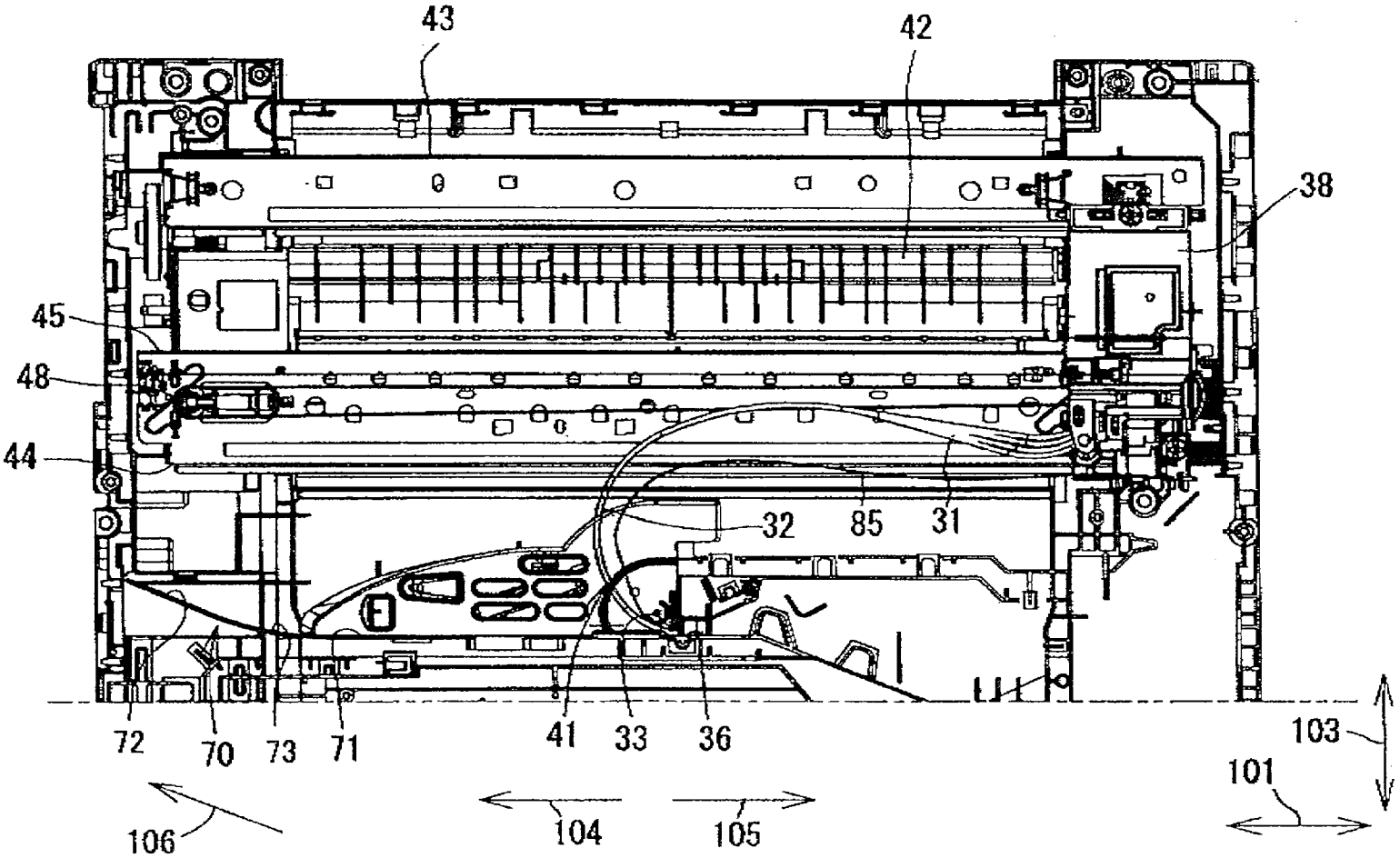
FIG. 6 is a plan view showing a structure around the image recording unit in a state in which the carriage is located at a right-side end in its reciprocation range.
Figure 7:
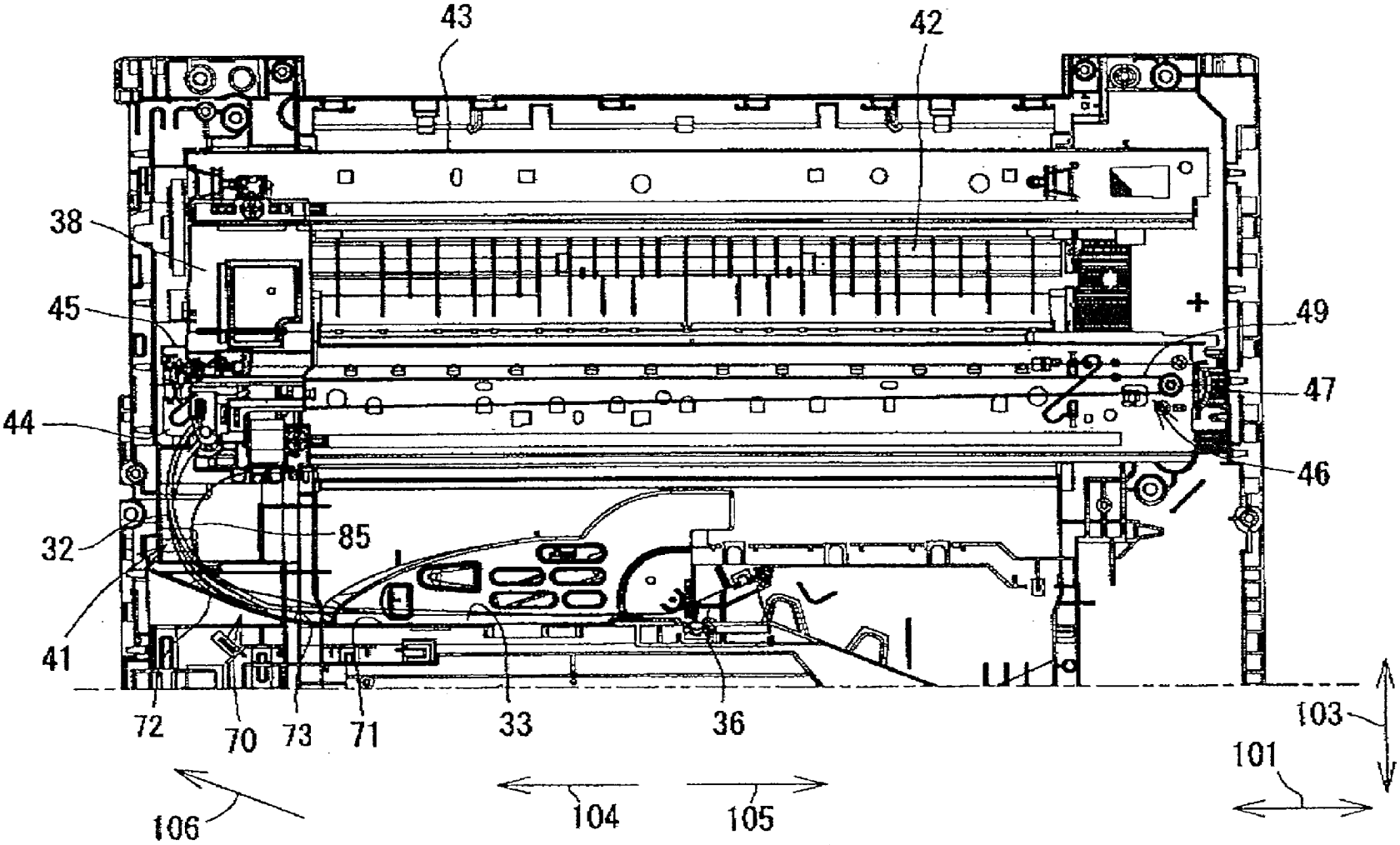
FIG. 7 is a plan view showing a structure around the image recording unit in a state in which the carriage is located at a left-side end in its reciprocation range.

When the carriage 38 reciprocates, the first section 31, the second section 32, and the third section 33 change their shapes following the reciprocating movement of the carriage 38. Due to the changes in the shapes, length ratios of the respective first through third sections 31-33 in each ink tube 41, namely, ranges in the ink tube 41 that are occupied by the respective first through third sections 31-33, vary. In this respect, it is noted that each of the first through third sections 31-33 does not constantly occupy a specific section in the ink tube 41 but changes due to elastic deformation of the ink tube 41 following the reciprocating movement of the carriage 38. For instance, as shown in FIG. 6, when the carriage 38 moves near to the right-side end in FIG. 6, the length ratio of the first section 31 in the ink tube 41 becomes large, the length ratio of the third section 33 in the ink tube 41 becomes small, and a radius of curvature of the second section 32 becomes large. On the other hand, as shown in FIG. 7, when the carriage 38 moves near to the left-side end in FIG. 7, the length ratio of the first section 31 in the ink tube 41 becomes small, the length ratio of the third section 33 in the ink tube 41 becomes large, and the radius of curvature of the second section 32 becomes small.

Figure 4:
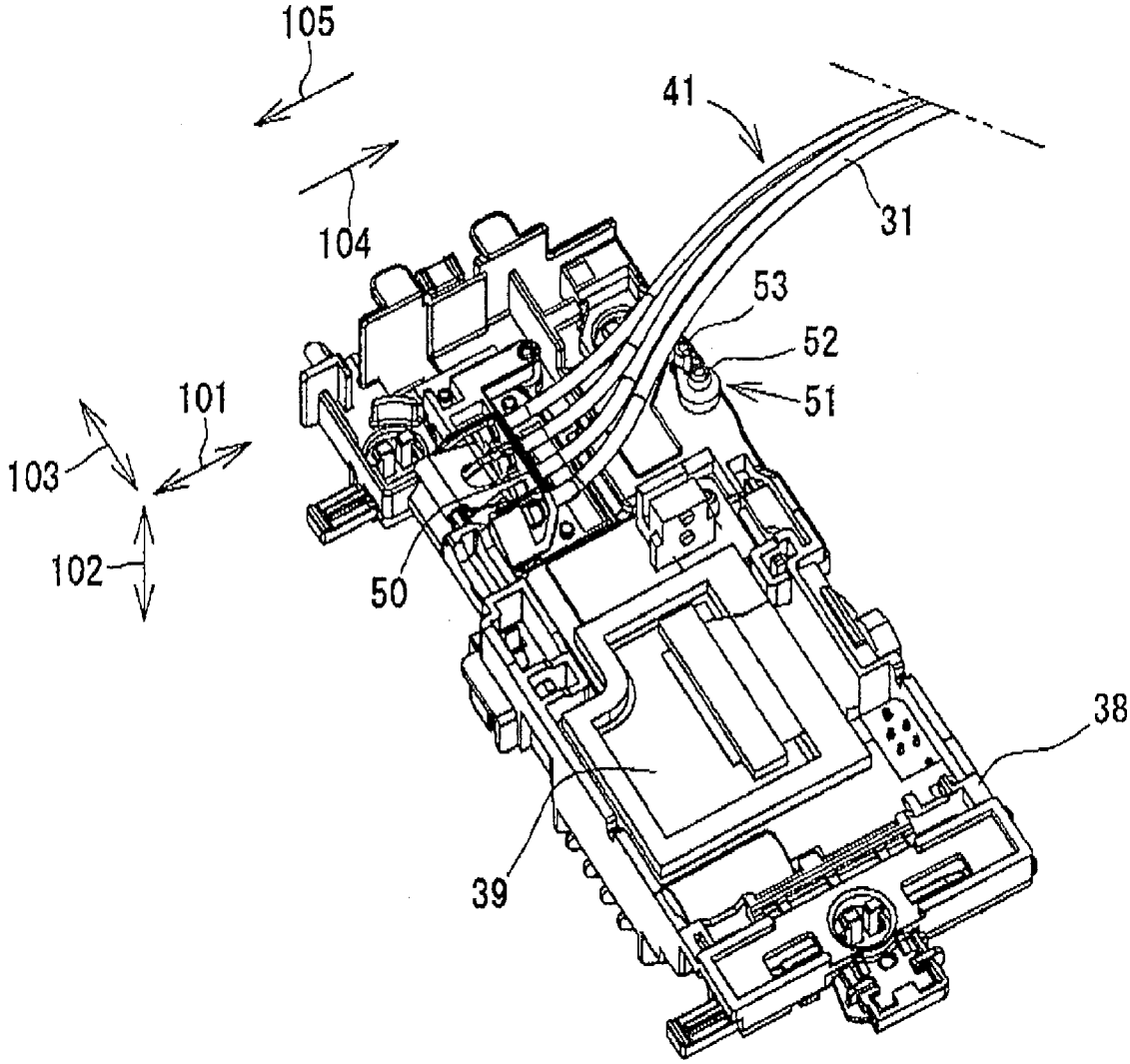
FIG. 4 is a perspective view showing a structure in which a first-end-side portion of each ink tube is connected to a carriage.

As shown in FIG. 4, the first-end-side portion of each ink tube 41 is connected to a joint member 50 on the carriage 38. The joint member 50 is disposed on the upper surface of the carriage 38. FIG. 4 shows a state in which an upper cover of the carriage 38 is removed. In FIG. 3, the joint member 50 is hidden from view by the upper cover of the carriage 38. While not shown specifically in FIG. 4, the joint member 50 includes four joints which are arranged so as to be spaced apart from each other at a suitable interval in the depth direction of the device 10 indicated by the arrow 103. The four ink tubes 41 are respectively connected to the four joints. The four joints of the joint member 50 protrude toward the first direction 104, whereby the first sections 31 of the respective ink tubes 41 connected to the respective joints extend in the first direction 104.

5. Push Member

The carriage 38 is provided with a push member 51 disposed so as to be distant from the joint member 60 in the first direction 104 in FIG. 4. The push member 51 is fitted on a pin 52 of the carriage 38 and is configured to be detachable from the carriage 38. The push member 51 has a cylindrical shape whose center is offset with respect to the axis of the pin 52 and has a pin 53 at a portion thereof that is the most distant from the pin 52. The pin 53 protrudes in the height direction of the device 10 (indicated by the arrow 102 in FIG. 4) and has a height larger than the outside diameter of each ink tube 41.

The pin 52 of the carriage 38 and the pin 53 of the push member 51 are arranged so as to be spaced apart from each other in the depth direction of the device 10 (indicated by the arrow 103 in FIG. 4), and the pin 53 is disposed nearer to the side of the clip 36 (i.e., the upper side in the direction indicated by the arrow 103 in FIG. 4) than the pin 52. Both of the pin 52 and the pin 53 are disposed nearer to the side of the clip 36 (i.e., the upper side in the direction indicated by the arrow 103 in FIG. 4) than one of the four ink tubes 41 that is nearest to the back of the device 10 (which is the lower side in the direction indicated by the arrow 103 in FIG. 4).

The pin 53 pushes the four ink tubes 41 arranged in the horizontal direction, toward the clip (36) side. The ink tubes 41 extending from the joint member 50 in the first direction 104 are pushed by the pin 53, so that the ink tubes 41 are elastically deformed toward the clip (36) side. Accordingly, the carriage 38 receives, via the pin 53, a force by which the shape of each ink tube 41 returns to the shape extending along the first direction 104. The direction of this force is substantially opposite to a direction toward the clip (36) side as seen in the depth direction of the device 10 that is indicated by the arrow 103 in FIG. 4, namely, the direction of the force is equal to a direction toward the lower side in the direction indicated by the arrow 103 in FIG. 4. Further, when the first section 31 of each ink tube 41 elastically deforms as described above, the radius of curvature of the second section 32 becomes small.

Figure 5:
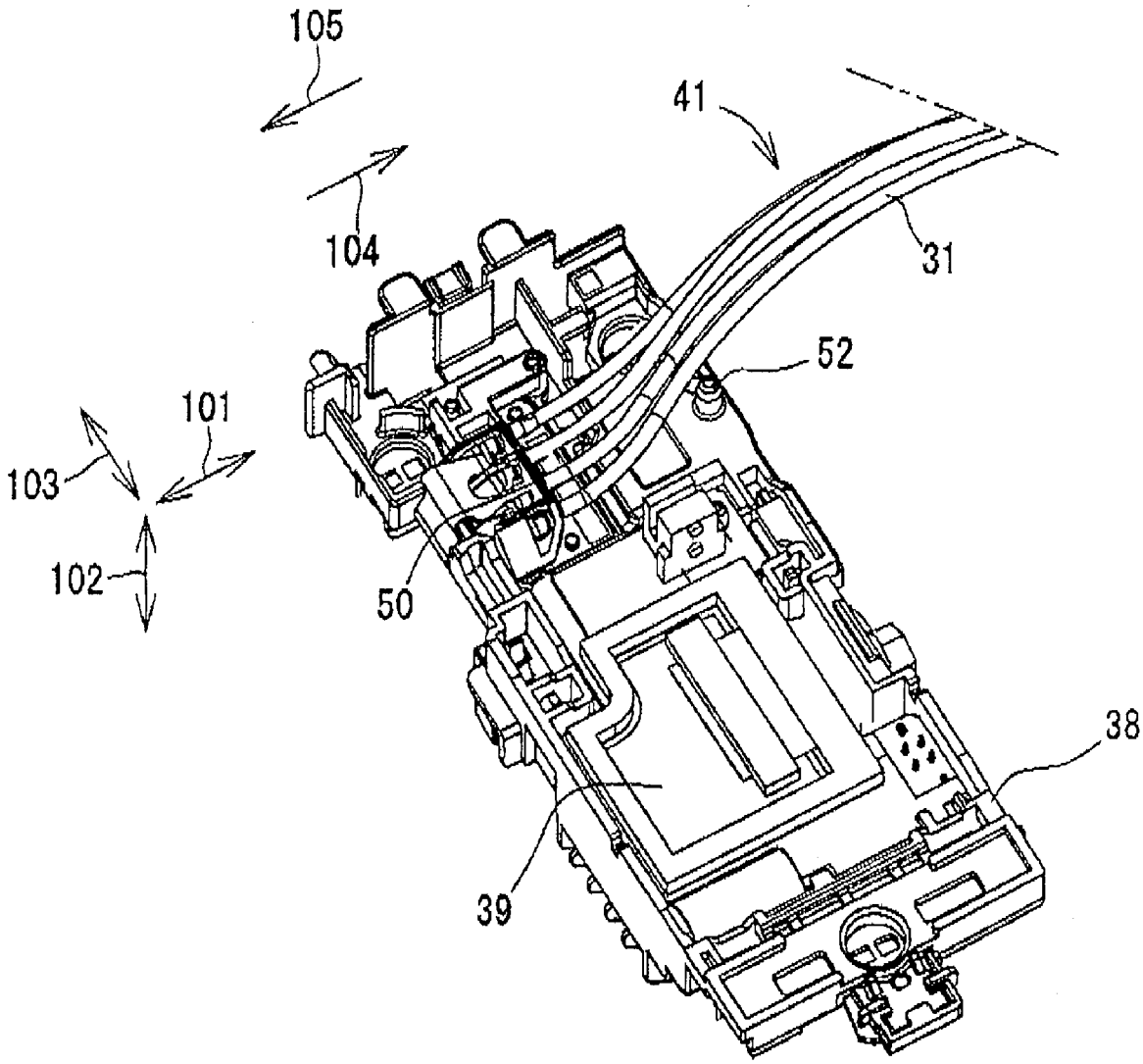
FIG. 5 is a perspective view showing a structure in which the first-end-side portion of each ink tube is connected to the carriage in a state in which a push member is removed.

When the push member 51 is removed from the pin 52 as shown in FIG. 5, the four ink tubes 41 arranged in the horizontal direction are pushed by the pin 52 toward the clip (36) side. The ink tubes 41 extending from the joint member 50 in the first direction 104 are elastically deformed toward the clip (36) side also in an instance where the ink tubes 41 are pushed by the pin 52. However, the elastic deformation of the ink tubes 41 when pushed by the pin 52 is smaller than that when pushed by the pin 53. Accordingly, the force by which the shape of each ink tube 41 returns to the shape extending along the first direction 104 is small. Further, the effect of reducing the radius of curvature of the second section 32 is decreased.

Attaching and detaching of the push member 51 to and from the pin 52 are carried out considering the length of each ink tube 41. For instance, the push member 51 is selectively attached to or detached from the pin 52 depending upon whether the maximum size of the recording sheet that can be used in the printing section 11 is A3 or A4. Where the maximum size is A3, the range of reciprocation of the carriage 38 is larger than an instance where the maximum size is A4, so that the length of each ink tube 41 increases. Accordingly, the ink tube 41 curved in the generally U-shape tends to expand in the depth direction of the device 10 indicated by the arrow 103. Where the U-shaped ink tube 41 expands largely, the ink tube 41 may contact other components such as the edge portion 46 of the guide rail 44, causing a risk of wear or damages of the ink tube 41. In view of this, the push member 51 is installed on the pin 52, whereby the ink tube 41 is elastically deformed largely so as to reduce the radius of curvature of the second section 32 of the ink tube 41. On the other hand, where the maximum size is A4, the U-shaped ink tube does not expand so much, as compared with an instance where the maximum size is A3. Accordingly, even if the push member 51 is not installed on the pin 52, it is possible to prevent the ink tube 41 from contacting other components due to the elastic deformation of the ink tube 41 by the pin 52 and to decrease the force by which the shape of each ink tube 41 returns to the shape extending along the first direction 104 for thereby reducing the influence of the force on the carriage 38.

6. Flat Cable

As shown in FIG. 3, a flat cable 85 is fixed at the clip 36 and extends to the carriage 38. The flat cable 85 is for transmitting electric signals between a control board (not shown) of the multi-function device 10 and a head control board (not shown) of the recording head 39. The flat cable 86 is an insulated thin ribbon-like member in which a plurality of conductive wires for transmitting the electric signals are coated with a synthetic resin film such as a polyester film.

The flat cable 85 has flexibility that permits the flat cable 85 to be flexed or deflected following the reciprocating movement of the carriage 38. The flat cable 85 has a generally U-shape at a portion thereof extending from the carriage 38 to the clip 36. That is, the flat cable 85 extends from the carriage 38 in the first direction 104 and subsequently turns so as to extend to the clip 36 in the second direction 105. The ribbon-like flat cable 85 is disposed such that a line which is perpendicular with respect to opposite surfaces of the flat cable 85 extends in the horizontal direction and such that the opposite surfaces extend in the vertical direction. Both of the direction in which the flat cable 85 extends from the carriage 38 and the direction in which the ink tubes 41 extend from the carriage 38 are the first direction 104.

A first-end-side portion of the flat cable 85 which is near to a first end thereof and which is fixed to the carriage 38 is electrically connected to the head control board (not shown) mounted on the carriage 38. A second-end-side portion of the flat cable 85 which is near to a second end thereof and at which the flat cable 85 is fixed by the clip 36 extends farther toward a main board and is electrically connected thereto. The generally U-shaped portion of the flat cable 85 is not fixed to any component and changes in shape following the reciprocating movement of the carriage 38, like the ink tubes 41.

7. Guide Member

As shown in FIG. 3, a guide member 70 is disposed at a position nearer to the front side of the device 10 than the ink tubes 41 and the flat cable 85, so as to extend along the width direction of the device 10 (indicated by the arrow 101 in FIG. 3). The guide member 70 is a wall member having a wall surface that extends in the vertical direction (indicated by the arrow 102 in FIG. 1) and that contacts the ink tubes 41. The guide member 70 is disposed so as to generally extend from the clip 36 by which the ink tubes 41 are fixed, to the vicinity of the left-side end of the device 10 as seen in FIG. 3, along the direction of extension of the ink tubes 41. The wall surface of the guide member 70 has a height enough to permit all of the four ink tubes 41 piled up in the vertical direction (indicated by the arrow 102 in FIG. 1) by the clip 36 to contact the wall surface.

The wall surface of the guide member 70 located on the side near to the ink tubes 41 functions as a guide surface. The guide surface is divided into three sections, i.e., a first guide surface 71, a second guide surface 72, and a third guide surface 73. The first guide surface 71 is a plane which extends in the second direction 105 so as to be held in contact with the third section 33 of each ink tube 41 for permitting the third section 33 to extend substantially straight in the second direction 105. The second guide surface 72 is a plane which extends in a third direction 106 that intersects the second direction 105 and with which the second section 32 of each ink tube 41 can come into contact. The second guide surface 72 guides the second section 32 in the third direction. The third guide surface 73 is a curved surface which is contiguous to the first guide surface 71 and the second guide surface 72 and which is curved with a first radius of curvature R1. The third guide surface 73 guides the second section 32 of the ink tube 41 such that the second section 32 comes into gentle contact with the second guide surface 72. In other words, the guide surface of the guide member 70 starts from the vicinity of the clip 36 toward the left-side end of the device 10 as seen in FIG. 3, so as to be contiguous in order from the first guide surface 71, the third guide surface 73, and the second guide surface 72.

Figure 8:
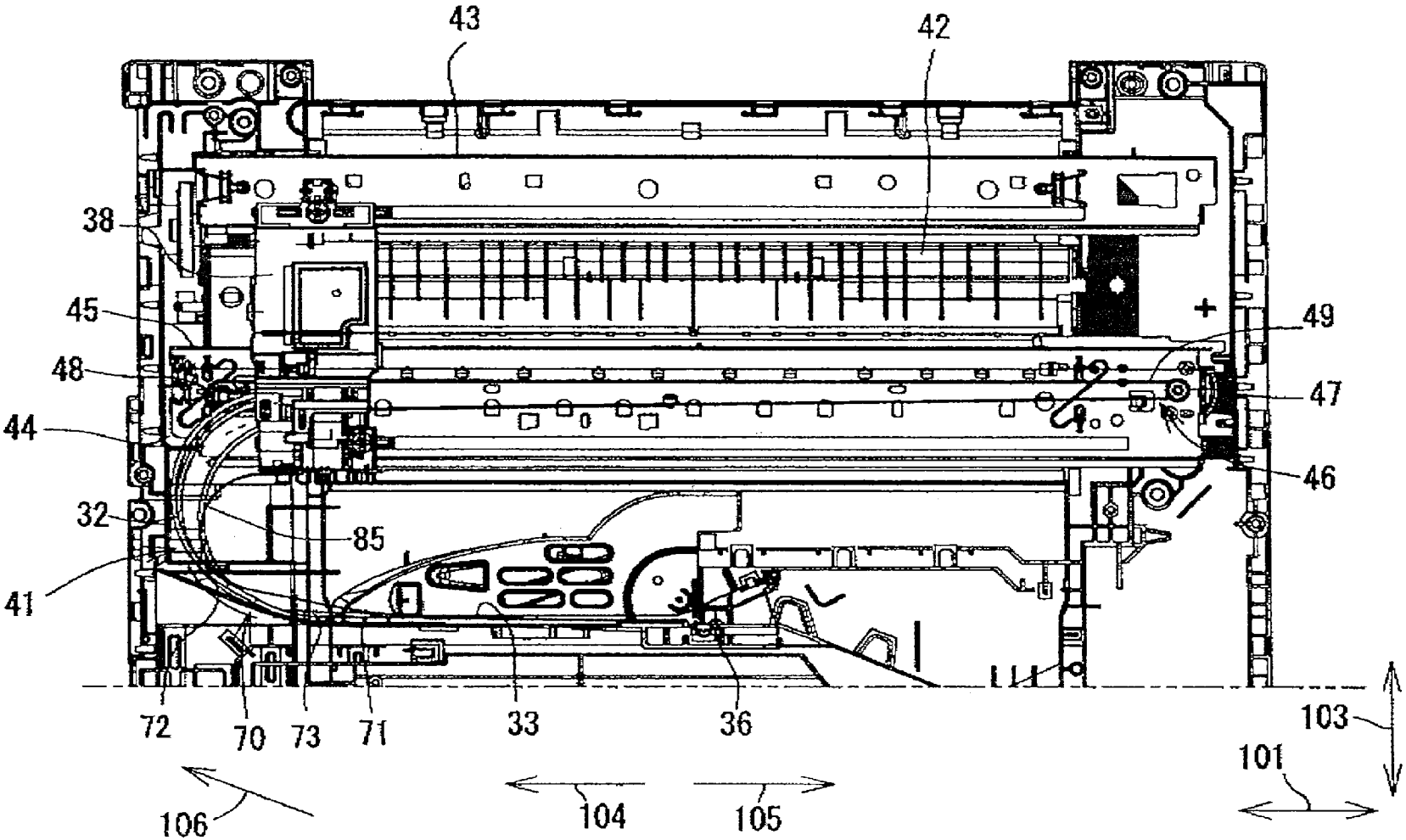
FIG. 8 is a plan view showing a structure around the image recording unit in a state in which each ink tube is in contact with a third guide surface of a guide member.
Figure 9:
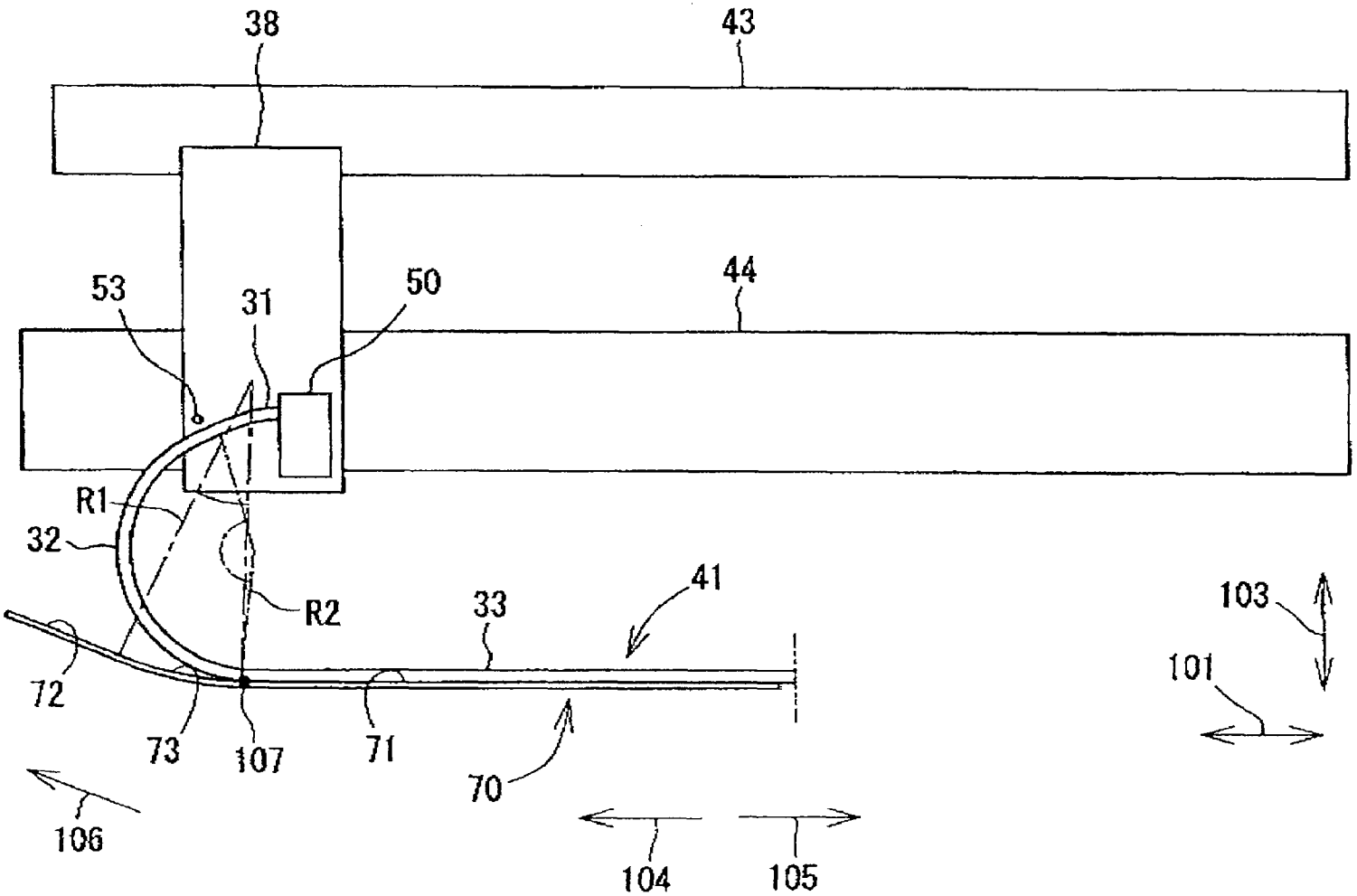
FIG. 9 is a schematic view showing the image recording unit in a state in which a second section of the ink tube begins to contact the third guide surface of the guide member.

As shown in FIGS. 8 and 9, the third guide surface 73 is curved with the first radius of curvature R1 such that the center of curvature is located on one of opposite sides of the guide surface 73 nearer to the carriage 38. The second section 32 of each ink tube 41 is curved with the second radius of curvature R2 such that the center of curvature is located on one of opposite sides of the second section 32 nearer to the carriage 38. That is, the direction in which the third guide surface 73 is curved is identical with the direction in which the second section 32 of the ink tube 41 is curved. The first radius of curvature R1 of the third guide surface 73 and the second radius of curvature R2 of the second section 32 of the ink tube 41 at a specific position satisfy the following formula (1). Here, the radius of curvature means a radius of the arcuate curved portion to the center of curvature.

$$\text{first radius of curvature } R1 \geqq \text{second radius of curvature } R2 \qquad \text{Formula (1)}$$

The second radius of curvature R2 is a radius of curvature of the second section 32 defined at a position where the second section 32 of the ink tube 41 reaches the third guide surface 73 of the guide member 70. This position corresponds to the above-indicated specific position and also corresponds to a boundary point 107 explained below. As described above, the ink tube 41 changes in shape following the reciprocating movement of the carriage 38. As shown in FIGS. 8 and 9, when the carriage 38 is located in the vicinity of the left-side end in its reciprocating range, the second section 32 of the ink tube 41 reaches and contacts the third guide surface 73 of the guide member 70.

In the present embodiment, the four ink tubes 41 are connected to the carriage 38. Accurately, the second radii of curvature R2 of the respective ink tubes 41 slightly vary from each other. However, the second radii of curvature R2 of any of the four ink tubes 41 satisfy the above formula (1). In the present embodiment, therefore, the following description will be made with respect to one of the four ink tubes 41 that is located at; the outermost position relative to the center of curvature.

Figure 10:
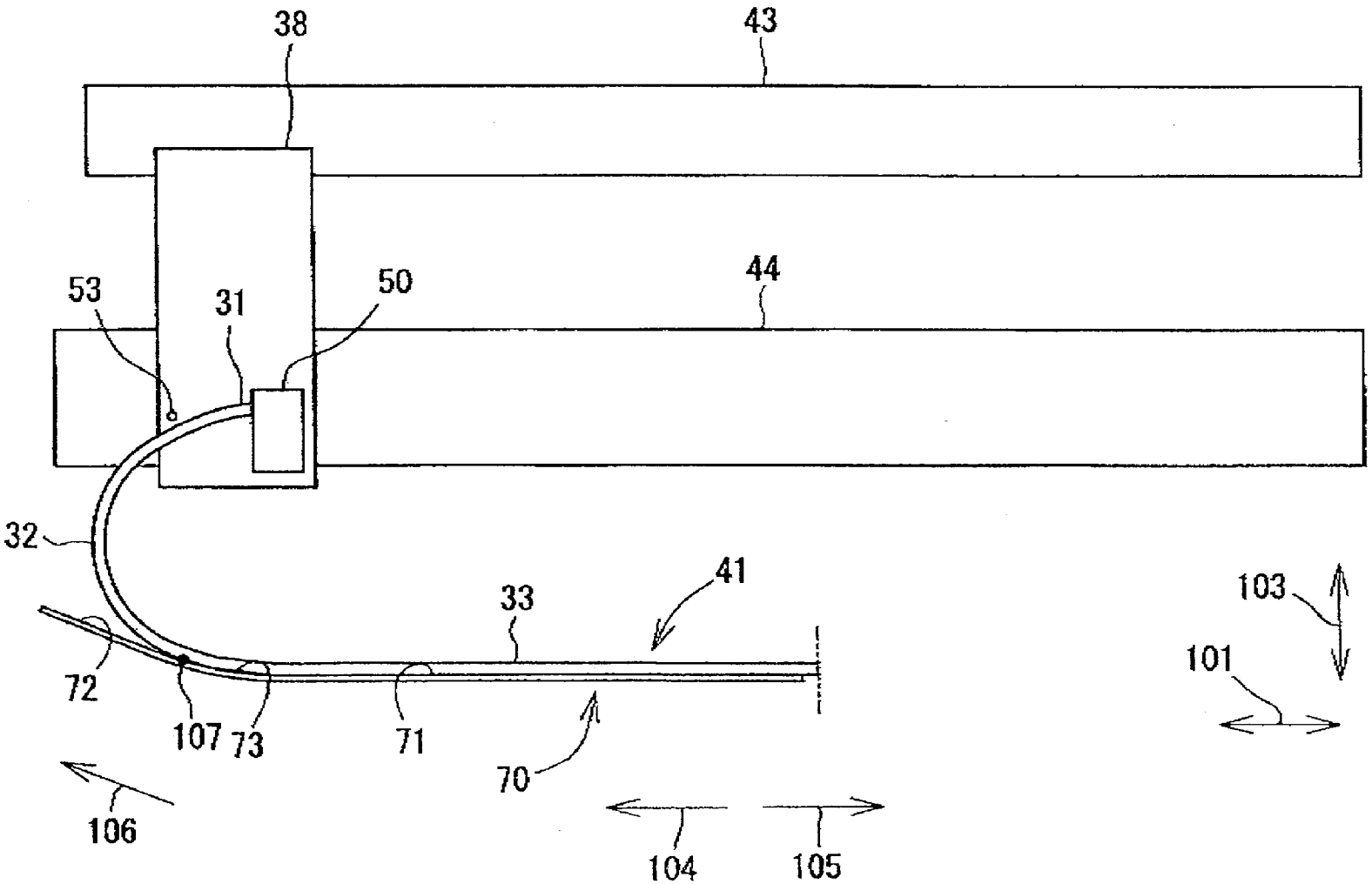
FIG. 10 is a schematic view showing the image recording unit in a state in which a boundary point in the second section of the ink tube transits on the third guide surface of the guide member.
Figure 11:
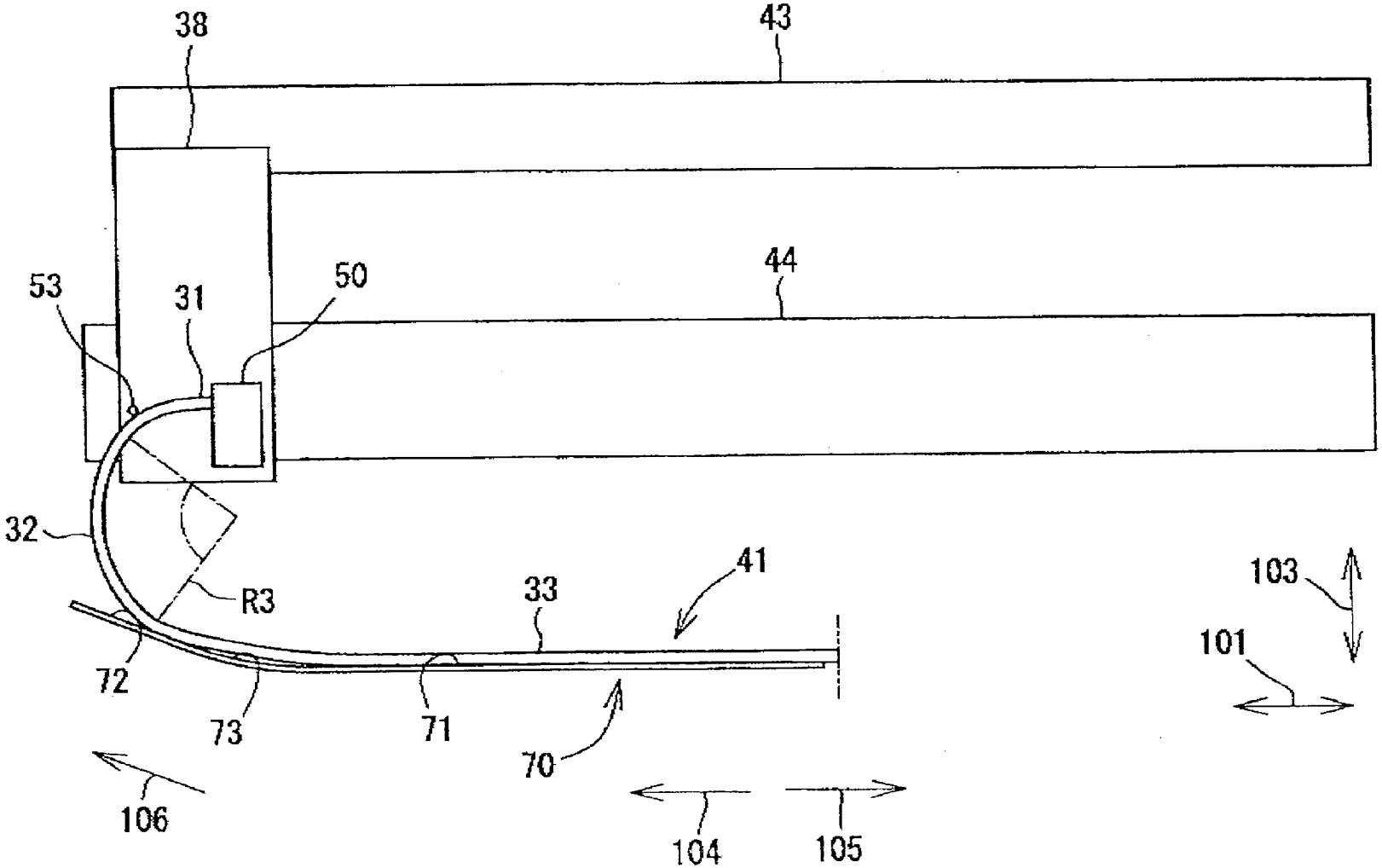
FIG. 11 is a schematic view showing the image recording unit in a state in which the carriage is located at a left-side end in its reciprocation range.

As shown in FIG. 10, the second guide surface 72 of the guide member 70 extends along the third direction 106 and gradually approaches the guide rail 44. When the carriage 38 is located at the left-side end in its reciprocating range, the second section 32 of the ink tube 41 reaches and contacts the second guide surface 72. The second section 32 of the ink tube 41 is pushed by the second guide surface 72 toward a direction in which the second section 32 approaches the carriage 38 (the guide rail 44). Where the radius of curvature of the second section 32 in this state is defined as a third radius of curvature R3, the second radius of curvature R2 and the third radius of curvature R3 satisfy the following formula (2):

$$\text{second radius of curvature } R2 > \text{third radius of curvature } R3 \qquad \text{Formula (2)}$$

8. Operations of Carriage and Ink Tube

There will be hereinafter explained operations of the carriage 38 and the ink tube 41 in the printing section 11. To the carriage 38 on which the recording head 39 is mounted, the drive force of the motor is transmitted via the belt drive mechanism 46, whereby the carriage 38 reciprocates in a direction intersecting the sheet-conveyance direction, i.e., in the direction indicated by the arrow 101, while being guided by the guide rails 43, 44. The recording head 39 that reciprocates with the carriage 38 selectively ejects, at a suitable timing, droplets of the inks of the different colors supplied through the respective ink tubes 41, onto the recording sheet supported on the platen 42, on the basis of the signals transmitted from the control board through the flat cable 85. The intermittent conveyance of the recording sheet by the sheet conveying roller 60 and sheet discharging roller 62 and the reciprocating movement of the carriage 38 are alternately repeated, whereby an intended image is recorded on the recording sheet. The carriage 38 is operated also in maintenance and initialization of the device 10, in addition to the image recording.

The ink tube 41 and the flat cable 85 connected to the carriage 38 change in shape following the reciprocating movement of the carriage 38. Although the flat cable 85 changes in shape like the ink tube 41, its detailed explanation is omitted.

As shown in FIG. 6, when the carriage 38 is located at the right-side end in its reciprocating range, the ink tube 41 assumes a U-shape in which the first section 31 is the longest, the radius of curvature of the second section 32 is the largest, and the third section 33 is the shortest or the third section does not substantially exist. As described above, the ink tube 41 has flexibility and bending rigidity. Accordingly, there is generated, in the second section 32 of the ink tube 41, a force by which the second section 32 is restored to the straight shape (hereinafter referred to as "restoring force" where appropriate). Due to the restoring force, the radius of curvature of the second section 32 becomes the largest, and the restoring force of the second section 32 is transmitted to the carriage 38 via the first section 31.

Due to the restoring force of the second section 32 of the ink tube 41, the radius of curvature of the second section 32 becomes large, so that the ink tube 41 curved in the U-shape tends to occupy a large space within the device 10. In this respect, the first section 31 is pushed toward the guide member 70 by the pin 53 provided on the carriage 38, whereby the first section 31 is elastically deformed slightly in an S-shape while extending in the first direction 104. There is also generated a restoring force by the elastic deformation of the first section 31, and the restoring force is transmitted to the carriage 38 via the pin 53. Further, the restoring force of the first section 31 is transmitted to the second section 32 and acts as a force to reduce the radius of curvature of the second section 32. Accordingly, it is possible to prevent the radius of curvature of the second section 32 from becoming excessively large, so that the ink tube 41 is shaped such that the space occupied by the ink tube 41 in the device 10 does not increase.

The restoring force of the second section 32 of the ink tube 41 is transmitted to the carriage 38 via the first section 31. As described above, the first section 31 is elastically deformed by the pin 53, so that the restoring force of the second section 32 acts on the carriage 38 as a force to push the pin 53 in a direction substantially perpendicular to the reciprocating direction (that is indicated by the arrow 101) of the carriage 38, namely, as a force to push the pin 53 toward the upper side in the direction indicated by the arrow 103 in FIG. 6, together with the restoring force of the first section 31. In other words, the restoring force of the second section 32 does not act on the carriage 38 as a force acting in a direction to rotate the posture of the carriage 38, namely, rotation moment.

When the carriage 38 is located at the left-side end in its reciprocating range as shown in FIG. 7, the ink tube 41 assumes a U-shape in which the first section 31 is the shortest or the first section 31 does not substantially exist, the radius of curvature of the second section 32 is the smallest, and the third section 32 is the longest. As described above, the restoring force is generated in the second section 32 of the ink tube 41 and is transmitted to the carriage 38 via the first section 31.

When the first section 31 becomes the shortest or the first section 31 does not exist, the ink tube 41 comes off the pin 53, whereby the restoring force of the second section 32 acts directly on the carriage 38 and the rotation moment may be generated in the carriage 38. In this instance, the second section 32 of the ink tube 41 is configured to be guided by the second guide surface 72 of the guide member 70 such that the radius of curvature is reduced to be equal to the third radius of curvature R3 smaller than the second radius of curvature R2, so that the length of the first section 31 is made larger than an instance where the radius of curvature of the second section 32 is equal to the second radius of curvature R2. Accordingly, it is possible to reduce a possibility that the restoring force of the second section 32 acts on the carriage as the rotation moment, so that the posture of the carriage is stabilized.

While the carriage 38 moves from the location indicated in FIG. 6 to the location indicated in FIG. 7, the ink tube 41 following the carriage 38 changes in shape such that the first section 31 gradually becomes short, the radius of curvature of the second section 32 gradually becomes small, and the third section 33 gradually becomes longer. During the movement of the carriage 88 described above, the third section 33 of the ink tube 41 is held in contact with the first guide surface 71 of the guide member 70 and extends straight in the second direction 105

Before the carriage 38 reaches the left-side end in its reciprocating range (FIG. 7), the second section 32 of the ink tube 41 reaches a boundary between the first guide surface 71 and the third guide surface 73. In this instance, a substantial part of the third section 33 is held in contact with the first guide surface 71 while the first section 31 and the second section 32 are not in contact with the guide member 70.

As the carriage 38 moves to the left-side end in its reciprocating range, the second section 32 of the ink tube 41 comes into contact with the third guide surface 73 gradually from a portion thereof near to a boundary with the third section 33. The above-indicated boundary point 107 (FIG. 9) in the second section 32 defines a boundary between a region of the second section 32 that is in contact with the third guide surface 73 and a region of the second section 32 that is not in contact with the third guide surface 73.

As described above, the third guide surface 73 is curved with the first radius of curvature R1. Further, the second section 32 is curved while changing its radius of curvature, following the movement of the carriage 38. When the carriage 38 is located at a position at which the second section 32 reaches the third guide surface 73 from the first guide surface 71, namely, when the boundary point 107 is present at a boundary between the first guide surface 71 and the third guide surface 73, the second section 32 is curved with the second radius of curvature R2, and the first radius of curvature R1 and the second radius of curvature R2 satisfy the above-indicated formula (1). In short, the third guide surface 73 is curved more gradually than the second section 32.

As the carriage 38 moves, the second section 32 comes into contact with the third guide surface 73 before coming into contact with the second guide surface 72, and is gradually guided from the second direction to the third direction so as to come into contact with the second guide surface 72. Since the third guide surface 73 is curved more gradually than the second section 32, the above-indicated boundary point 107 is constantly present at only one location in the second section 32. As the carriage 38 moves, the boundary point 107 transits on the third guide surface 73 from a boundary with the first guide surface 71 to a boundary with the second guide surface 72, so that the second section 32 begins to gently contact the second guide surface. When the carriage 38 moves to the left-side end in its reciprocating range, the second section 32 is gradually guided by the second guide surface 72 in a direction toward the guide rail 44 along the third direction. In other words, the second section 32 is guided by the third guide surface 73 so as to come into gentle contact with the second guide surface 72.

In the illustrated embodiment, when the ink tube 41 contacting the first guide surface 71 moves so as to come into contact with the second guide surface 72 following the carriage 38, the boundary point 107 transits on the third guide surface 73 from the first guide surface 71 toward the second guide surface 72. Accordingly, the ink tube 41 is prevented from abruptly contacting the guide member 70, thereby reducing a butting noise generated upon contact of the ink tube 41 with the guide member 70. Thus, it is possible to realize the printing section 11 which is quiet in the operation sound during the reciprocating movement of the carriage 38

Further, the radius of curvature of the second section 32 is made small by the second guide surface 72, so as to reduce the possibility that the restoring force by which the second section 32 is restored to the straight shape acts on the carriage 38 as the rotation moment. Accordingly, it is possible to stabilize the posture of the carriage 38 during its reciprocating movement and upon changing of the reciprocating direction, resulting in a smooth reciprocating movement of the carriage 388

The carriage 38 is provided with the pin 53 which is for pushing the first section 31 of the ink tube 41 toward the guide member 70 so as to elastically deform the first section 31, thereby preventing the radius of curvature of the second section 32 from becoming excessively large due to the restoring force of the second section 32. Accordingly, the ink tube 41 can be shaped so as to reduce the range within which the ink tube 41 changes in shape, and the restoring force of the second section 32 can be prevented from acting on the carriage 38 as the rotation moment.

In the illustrated embodiment, the work device according to the invention is realized as a part of the printing section 11. The work device according to the invention may be realized as a part of a scanner. In this instance, a carriage on which an image sensor is mounted functions as the movable member while an electric cable for transmitting electric signals between the image sensor and a control board functions as the lengthy member.

In the illustrated embodiment, the reciprocating direction of the carriage 38 is constituted by mutually opposite directions, and the first direction 104 and the second direction 105 in which the ink tube 41 extends coincide with the reciprocating direction of the carriage 38. The first and second directions may not coincide with the reciprocating direction of the carriage 38, but may be arbitrarily changed within the principle of the invention.

In the illustrated embodiment, the ink tube 41 functions as the lengthy member. The lengthy member is not limited to the ink tube 41, but may be any members such as the flat cable 85, provided that the lengthy member is a tube-like member, a ribbon-like member or the like.

In the illustrated embodiment, the third guide surface 73 of the guide member 70 is curved with the first radius of curvature R1 which is constant. The first radius of curvature R1 may not be constant, as long as the third guide surface 73 is configured such that the boundary point 107 transits on the third guide surface 73 from the first guide surface 71 toward the second guide surface 72. Accordingly, the third guide surface 73 may be configured as a curved surface having a plurality of radii of curvature larger than the second radius of curvature.

What is claimed is:

1. A work device, comprising:

a movable member configured to reciprocate in a certain direction;

a lengthy member which is connected to the movable member at a first-end-side portion near to a first end thereof, so as to extend in a first direction, and is elastically curved toward a second direction different from the first direction so that a second-end-side portion near to a second end thereof is fixed at a prescribed position, the lengthy member being operable to follow a reciprocating movement of the movable member; and a guide member having a first guide surface extending along the second direction, a second guide surface extending in a third direction that intersects the second direction, and a third guide surface contiguous to the first guide surface and the second guide surface, wherein the third guide surface is configured such that a boundary point in the lengthy member transits on the third guide surface from the first guide surface toward the second guide surface when the lengthy member contacting the first guide surface moves so as to come into contact with the second guide surface following the reciprocating movement of the movable member, the boundary point defining a boundary between a region of the lengthy member that is in contact with the third guide surface and a region of the lengthy member that is not in contact with the third guide surface.

2. The work device according to claim 1, wherein the lengthy member includes a first section in which the first-end-side portion is provided and which extends in the first direction, a second section which is elastically curved from the first section toward the second direction, and a third section in which the second-end-side portion is provided and which extends from the second section in the second direction, wherein the first guide surface is in contact with the third section of the lengthy member, the second guide surface is capable of contacting the second section of the lengthy member, and the third guide surface is curved with a first radius of curvature R1, and wherein the first radius of curvature R1 and a second radius of curvature R2 which is a radius of curvature of the second section defined when the movable member is located at a position at which the boundary point is present at a boundary between the first guide surface and the third guide surface satisfy the following formula:

first radius of curvature R1≧second radius of curvature R2.

3. The work device according to claim 2, wherein the second guide surface is configured to guide the second section such that the radius of curvature of the second section becomes small when the lengthy member contacting the first guide surface moves so as to come into contact with the second guide surface following the reciprocating movement of the movable member.

4. The work device according to claim 2, wherein the movable member is provided with a push member configured to push the first section of the lengthy member toward the guide member, thereby elastically deforming the first section.

5. The work device according to claim 1, wherein the movable member is a carriage on which a recording head is mounted, and wherein the lengthy member is an ink tube.

6. An image recording apparatus including the work device defined in claim 5 and configured to convey a recording medium in a direction that intersects the certain direction in which the carriage reciprocates and to perform image recording by attaching ink droplets ejected from the recording head to the recording medium.

* * * * *